US010606193B2

(12) United States Patent
Yagi et al.

(10) Patent No.: US 10,606,193 B2
(45) Date of Patent: Mar. 31, 2020

(54) FIXING DEVICE AND IMAGE FORMING APPARATUS

(71) Applicant: FUJI XEROX CO., LTD., Tokyo (JP)

(72) Inventors: Motoyuki Yagi, Kanagawa (JP); Noriaki Kishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/167,542

(22) Filed: Oct. 23, 2018

(65) Prior Publication Data

US 2019/0369531 A1 Dec. 5, 2019

(30) Foreign Application Priority Data

Jun. 4, 2018 (JP) ..... 2018-107062

(51) Int. Cl.
*G03G 15/20* (2006.01)

(52) U.S. Cl.
CPC ..... *G03G 15/2017* (2013.01); *G03G 15/2064* (2013.01); *G03G 2215/2019* (2013.01); *G03G 2215/2041* (2013.01)

(58) Field of Classification Search
CPC ..... G03G 15/2017; G03G 15/2064; G03G 2215/2019; G03G 2215/2041
See application file for complete search history.

(56) References Cited

U.S. PATENT DOCUMENTS 9,020,409 B2 * 4/2015 Kuroda ..... G03G 15/2053 399/329

FOREIGN PATENT DOCUMENTS

JP 2005258108 9/2005
JP 2006030346 2/2006

* cited by examiner

*Primary Examiner* — David M. Gray
*Assistant Examiner* — Michael A Harrison
(74) *Attorney, Agent, or Firm* — JCIPRNET

(57) ABSTRACT

A fixing device includes an endless belt; a pressing unit that is in contact with an outer peripheral surface of the belt and that rotates the belt; a first unit that is provided on an inner peripheral surface of the belt and that retains the belt in contact with the pressing unit; a second unit provided on the inner peripheral surface of the belt and located downstream of the first unit in a rotation direction of the belt, the second unit applying tension to the belt and including a portion that is in contact with a central portion of the belt in a width direction of the belt and that is farther in a direction toward the outer peripheral surface of the belt than both ends of the belt in the width direction of the belt; and a third unit provided on the inner peripheral surface of the belt and located downstream of the second unit in the rotation direction of the belt, the third unit applying tension to the belt and including a portion that is in contact with the central portion of the belt in the width direction of the belt and that is farther in the direction toward the outer peripheral surface of the belt than both ends of the belt in the width direction of the belt.

8 Claims, 8 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2018-107062 filed Jun. 4, 2018.

BACKGROUND (i) Technical Field

The present disclosure relates to a fixing device and an image forming apparatus.

(ii) Related Art

Japanese Unexamined Patent Application Publication No. 2005-258108, for example, discloses a fixing device that fixes a toner image on a sheet to the sheet. This fixing device includes a heating roller, a pressing roller, a belt that is disposed between the heating roller and the pressing roller and rotates while tension is applied thereto, and a member that applies the tension to the belt. The sheet is transported to a gap between the heating roller and the belt that rotates, and receives heat from the heating roller and pressure from the pressing roller so that the toner image on the sheet is fixed to the sheet. The member that applies the tension to the belt has projections at the ends thereof in the width direction of the belt to prevent snaking of the belt.

SUMMARY

A movement of the fixing belt in the width direction may be limited by components that come into contact with end portions of the belt in the width direction. However, when a force that moves the belt in the width direction increases, the belt receives a large force and there is a risk that the belt will be damaged.

Aspects of non-limiting embodiments of the present disclosure relate to a configuration in which a movement of a fixing belt in a width direction is less than that in a configuration in which the belt receives a uniform tension in the width direction.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing device including an endless belt; a pressing unit that is in contact with an outer peripheral surface of the belt and that rotates the belt; a first unit that is provided on an inner peripheral surface of the belt and that retains the belt in contact with the pressing unit; a second unit provided on the inner peripheral surface of the belt and located downstream of the first unit in a rotation direction of the belt, the second unit applying tension to the belt and including a portion that is in contact with a central portion of the belt in a width direction of the belt and that is farther in a direction toward the outer peripheral surface of the belt than both ends of the belt in the width direction of the belt; and a third unit provided on the inner peripheral surface of the belt and located downstream of the second unit in the rotation direction of the belt, the third unit applying tension to the belt and including a portion that is in contact with the central portion of the belt in the width direction of the belt and that is farther in the direction toward the outer peripheral surface of the belt than both ends of the belt in the width direction of the belt.

BRIEF DESCRIPTION OF THE DRAWINGS

An exemplary embodiment of the present disclosure will be described in detail based on the following figures, wherein.

DETAILED DESCRIPTION

Exemplary Embodiment

Overall Structure

Figure 1:
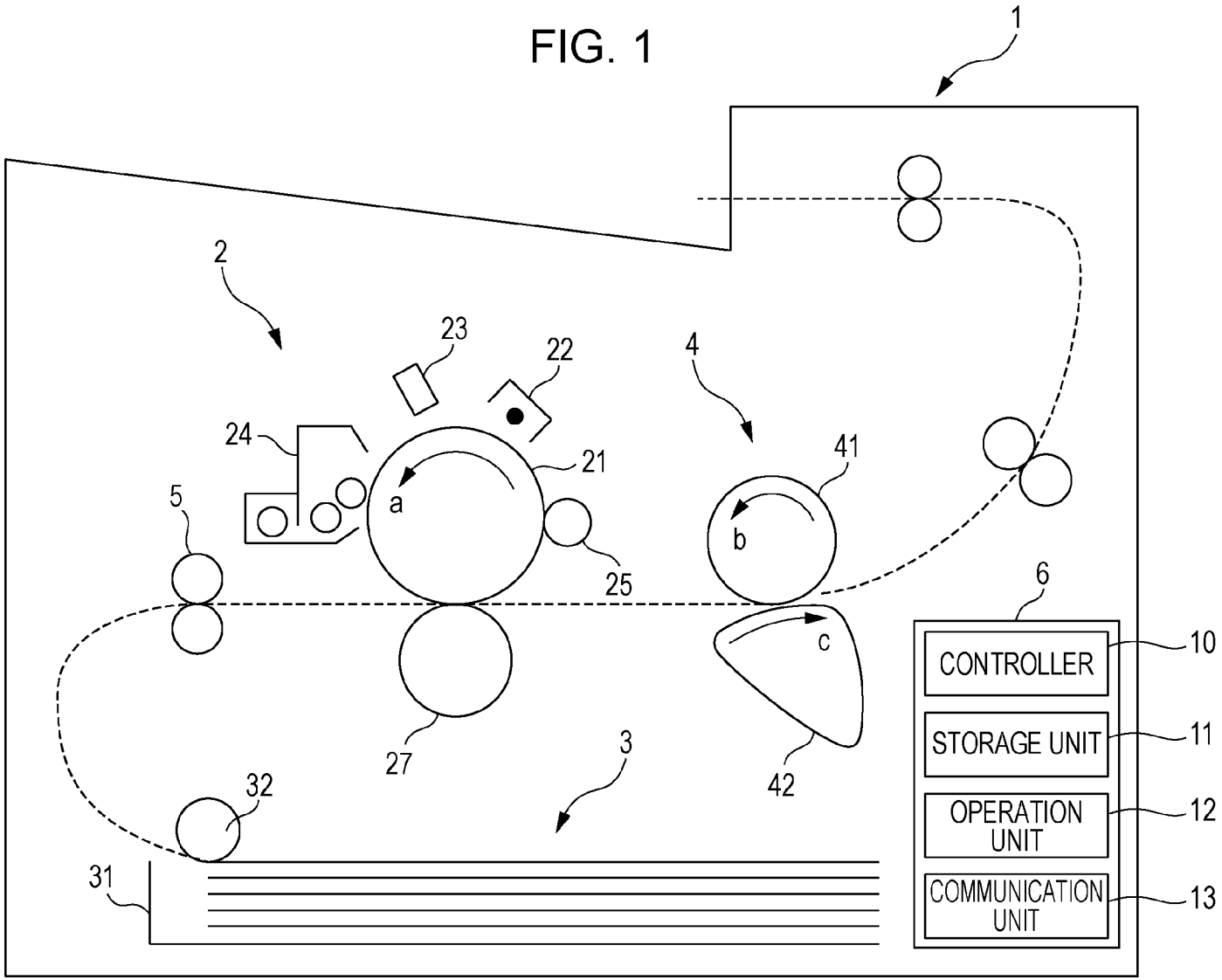
FIG. 1 illustrates the structure of an image forming apparatus according to an exemplary embodiment of the present disclosure.

FIG. 1 illustrates the structure of an image forming apparatus 1 according to an exemplary embodiment of the present disclosure. The image forming apparatus 1 includes an image forming section 2 that forms a toner image on a recording paper sheet, a sheet supplying unit 3 that supplies the recording paper sheet to the image forming section 2, a fixing device 4 that fixes the toner image formed on the recording paper sheet to the recording paper sheet, plural transport rollers 5 that transport the recording paper sheet, and a control unit 6 that controls the above-mentioned components.

The control unit 6 includes a controller 10, a storage unit 11, an operation unit 12, and a communication unit 13. The operation unit 12 includes a touch panel and plural buttons, and receives various inputs and instructions from a user. The communication unit 13 receives image data transmitted from an external device, such as a personal computer (not shown). The storage unit 102 includes, for example, a nonvolatile memory, and stores the image data received from the external device. The controller 10 includes a central processing unit (CPU), a random access memory (RAM), and a read only memory (ROM). The CPU carries out operations based on programs (software) stored in the ROM and transferred to hardware, such as the CPU or RAM. Thus, the CPU realizes the functions of the image forming apparatus 1 by controlling the storage unit 11, the operation unit 12, the communication unit 13, the image forming section 2, the sheet supplying unit 3, the fixing device 4, and the transport rollers 5 and also controlling the operation of reading/writing data from/to the RAM and the storage unit 11.

The image forming section 2 forms an image on the recording paper sheet based on the image data supplied from the external device. The image forming section 2 includes a photoconductor 21 that rotates in the direction of arrow a in FIG. 1. A charging device 22 charges the photoconductor 21 to a uniform potential. An exposure unit 23 emits light modulated based on the image data toward the photoconductor 21 that is charged, thereby forming an electrostatic latent image on the photoconductor 21.

A developing device 24 develops the electrostatic latent image formed on the photoconductor 21. The developing device 24 develops the electrostatic latent image formed on the photoconductor 21 by using toner, thereby forming a toner image on the photoconductor 21. A cleaner 25 removes the toner that has not been transferred to the recording paper sheet and remained on the photoconductor 21. The toner that has not been transferred to the recording paper sheet and remained on the photoconductor 21 is collected by the cleaner 25. A transfer roller 27 is arranged to face the photoconductor 21. The transfer roller 27 and the photoconductor 21 form a nip region therebetween in which the toner image formed on the photoconductor 21 is transferred to the recording paper sheet.

The sheet supplying unit 3 includes a container 31 that contains recording paper sheets and a feed roller 32 that feeds the recording paper sheets from the container 31. Each recording paper sheet fed from the container 31 by the feed roller 32 is transported to the image forming section 2 by the transport rollers 5.

The fixing device 4 includes a fixing roller 41 and an endless fixing belt 42. The fixing device 4 is an example of a fixing device according to an exemplary embodiment of the present disclosure. The fixing roller 41 is an example of a pressing unit according to an exemplary embodiment of the present disclosure, and the fixing belt 42 is an example of a belt according to an exemplary embodiment of the present disclosure. The fixing roller 41 rotates in the direction of arrow b in FIG. 1. The fixing belt 42 is in contact with the fixing roller 41, and rotates in the direction of arrow c in FIG. 1 when the fixing roller 41 rotates. The fixing roller 41 and the fixing belt 42 face each other and are in contact with each other to form a nip region therebetween. The fixing roller 41 has a heat source therein, and the surface thereof is heated by the heat source, so that the toner image formed on the recording paper sheet that has been transport to the nip region is also heated. The fixing roller 41 and the fixing belt 42 apply a pressure for pressing the toner image against the recording paper sheet in the nip region. The fixing roller 41 and the fixing belt 42 fix the toner image formed on the recording paper sheet to the recording paper sheet by applying heat and pressure to the recording paper sheet. The recording paper sheet to which the toner image has been fixed is discharged from the image forming apparatus 1 by the transport rollers 5.

Figure 2:
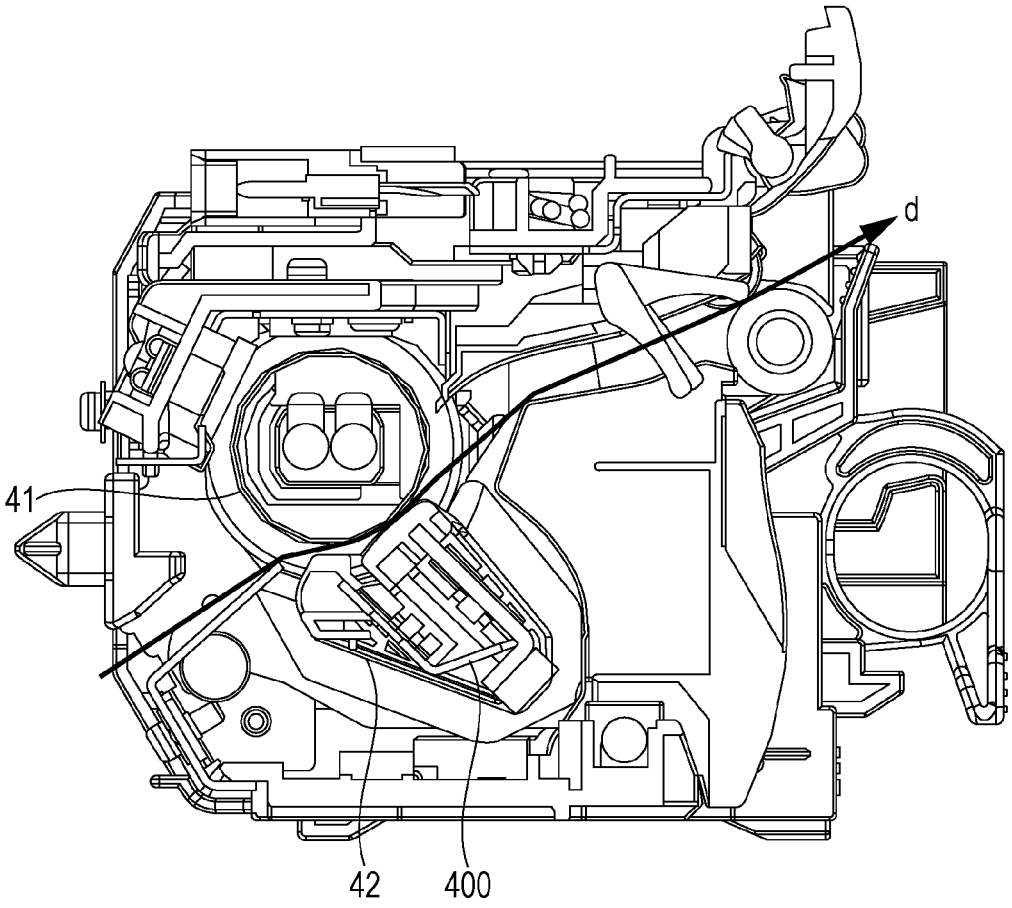
FIG. 2 illustrates the internal structure of a fixing device viewed in an axial direction of a fixing roller.

FIG. 2 illustrates the internal structure of the fixing device 4 viewed in the axial direction of the fixing roller 41. The recording paper sheet that has been transported from the image forming section 2 is transported through the fixing device 4 in the direction of arrow d in FIG. 2. A pad 400 is disposed inside the inner peripheral surface of the fixing belt 42. The pad 400 applies tension to the fixing belt 42 by expanding the fixing belt 42 in directions from the inner peripheral surface toward the outer peripheral surface of the fixing belt 42. The pad 400 receives a force in a direction toward the fixing roller 41 from a component that is not illustrated. This force pushes the pad 400 toward the fixing roller 41, so that the thus-pushed pad 400 presses the fixing belt 42 against the fixing roller 41.

Figure 3:
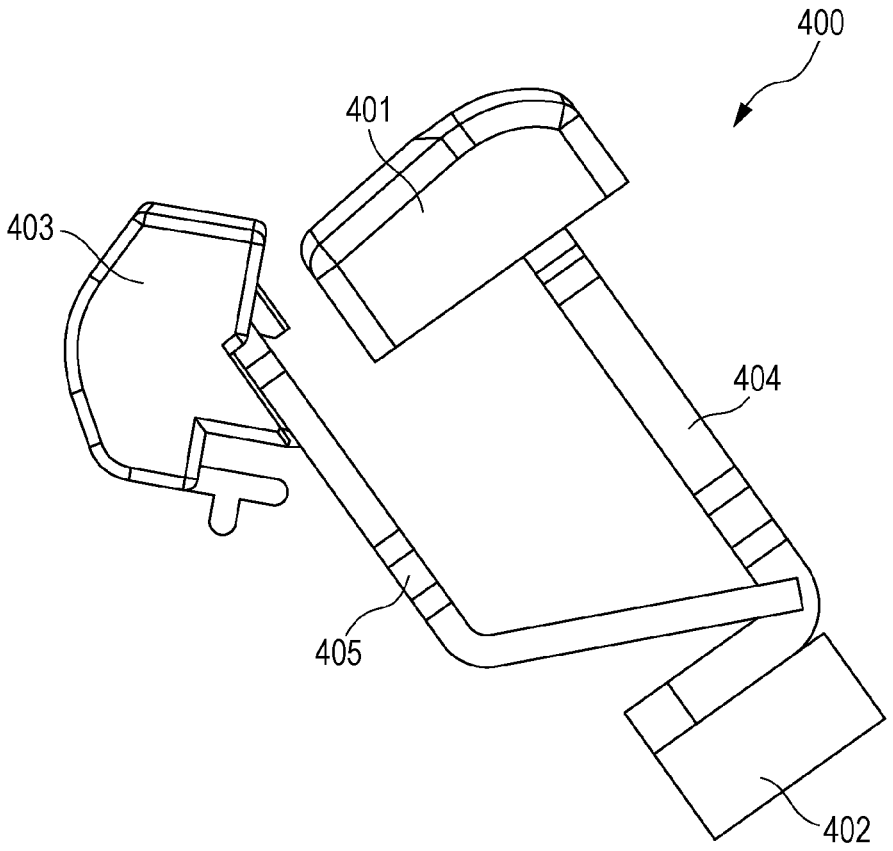
FIG. 3 illustrates a pad viewed in a width direction of a fixing belt.
Figure 4:
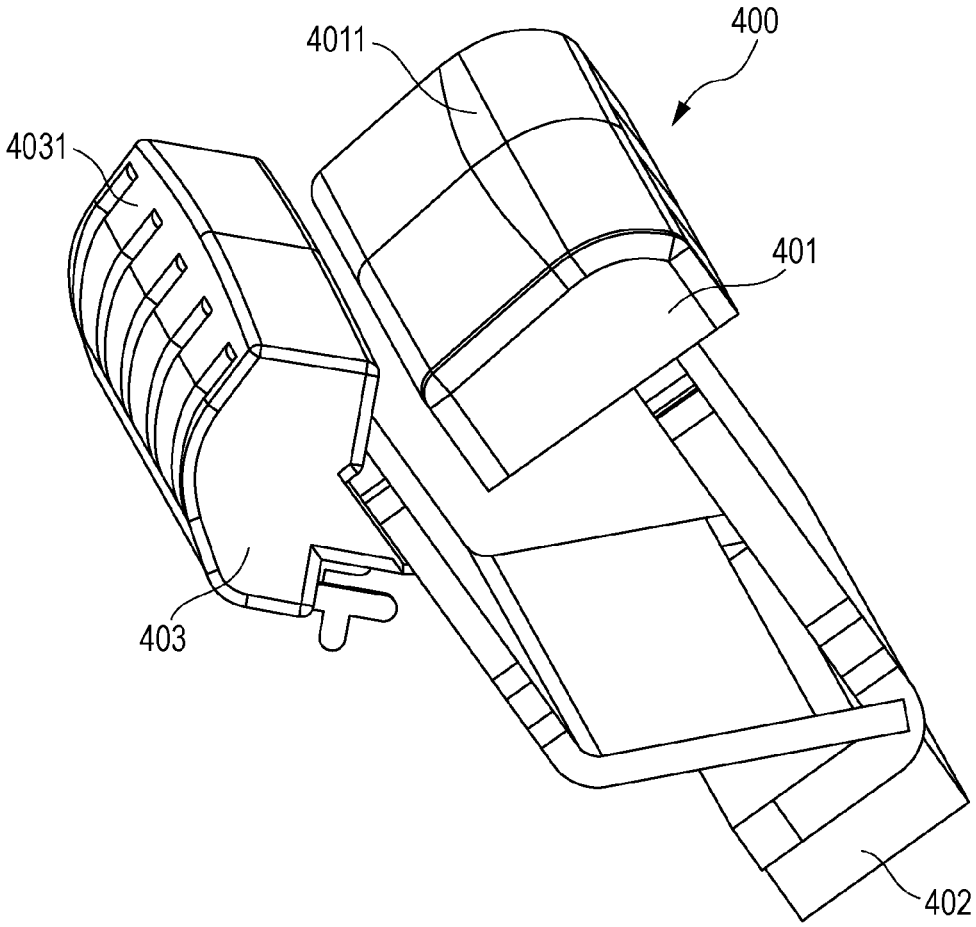
FIG. 4 illustrates a first contact surface and a third contact surface.
Figure 5:
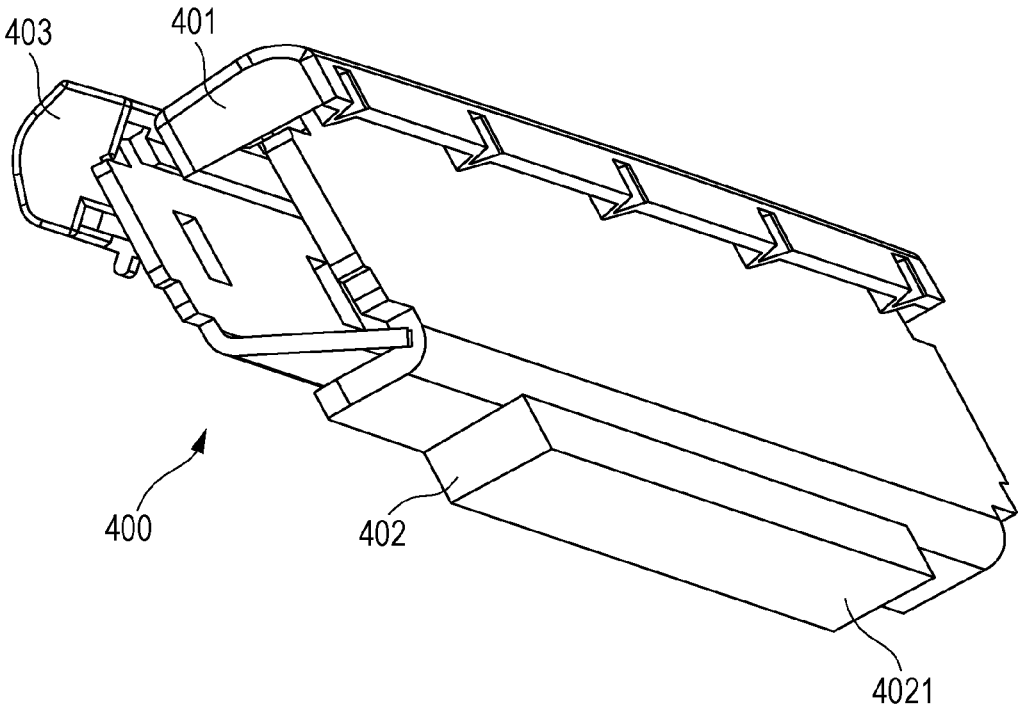
FIG. 5 illustrates a second contact surface.

FIG. 3 illustrates the pad 400 viewed in the width direction of the fixing belt 42. The pad 400 includes a first component 401, a second component 402, and a third component 403 that are in contact with the inner peripheral surface of the fixing belt 42. The pad 400 also includes a first base portion 404 that supports the first component 401 and the second component and a second base portion 405 that supports the third component 403. FIG. 4 illustrates a first contact surface 4011 of the first component 401 that is in contact with the fixing belt 42 and a third contact surface 4031 of the third component 403 that is in contact with the fixing belt 42 to apply tension to the fixing belt 42. FIG. 5 illustrates a second contact surface 4021 of the second component 402 that is in contact with the fixing belt 42 to apply tension to the fixing belt 42.

The first component 401 holds the fixing belt 42 in contact with the fixing roller 41 to form the nip region in which the recording medium is disposed between the fixing roller 41 and the fixing belt 42. The first component 401 is made of a resin. The first component 401 is an example of a first unit according to an exemplary embodiment of the present disclosure. The first contact surface 4011 of the first component 401 is longer than the width of the fixing belt 42 in the width direction of the fixing belt 42, and presses the fixing belt 42 against the fixing roller 41 over the entire width thereof. When viewed in the rotation direction of the fixing belt 42, the first contact surface 4011 is flat from one end to the other end thereof in the width direction of the fixing belt 42.

Figure 6:
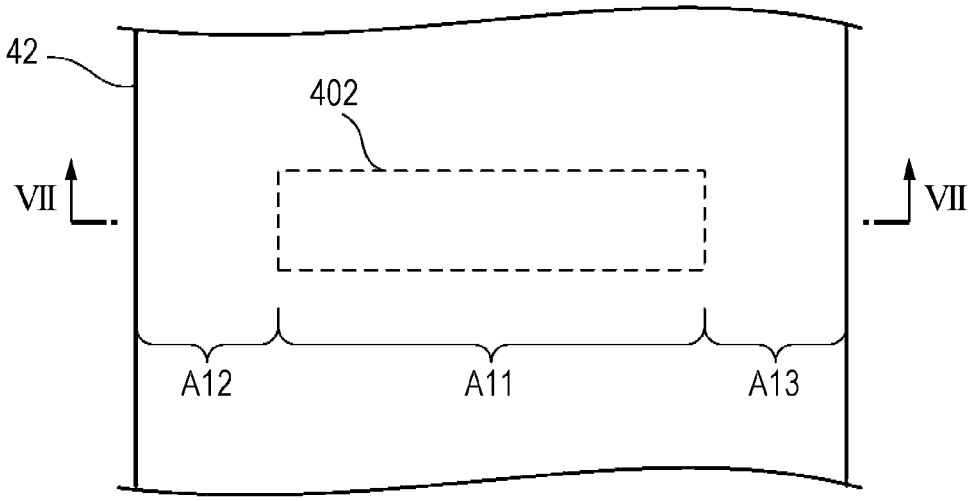
FIG. 6 illustrates a portion of the fixing belt that is in contact with a second component, viewed from the outer periphery of the fixing belt.
Figure 7:
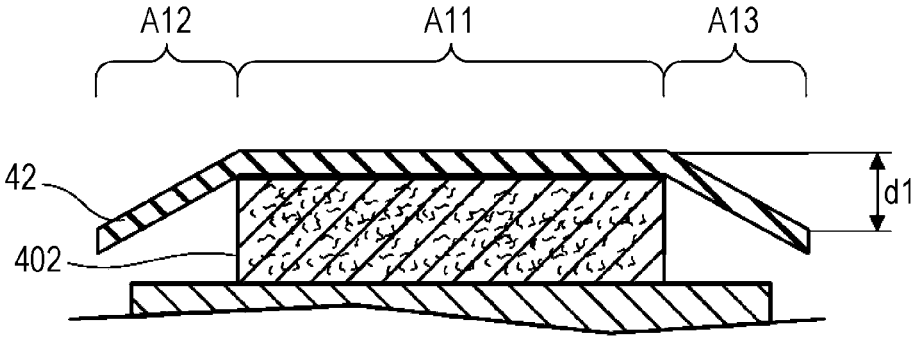
FIG. 7 is a sectional view of FIG. 6 taken along line VII-VII.

The second component 402 applies tension to the fixing belt 42. The second component 402 is rectangular-parallelepiped-shaped and is made of, for example, felt. The second contact surface 4021 that is in contact with the fixing belt 42 is flat. The second component 402 is an example of a second unit according to an exemplary embodiment of the present disclosure. The second component 402 is disposed on an extension line of a line connecting the rotation axis (center axis) of the fixing roller 41 and the first component 401, and is located downstream of the first component 401 in the rotation direction of the fixing belt 42 (direction of arrow c). FIG. 6 illustrates a portion of the fixing belt 42 that is in contact with the second component 402, viewed from the outer periphery of the fixing belt 42. FIG. 7 is a sectional view of FIG. 6 taken along line VII-VII. The second component 402 is shorter than the width of the fixing belt 42 in the width direction of the fixing belt 42. When viewed in a direction normal to the fixing belt 42, the second component 402 is disposed in a central region between both ends of the fixing belt 42 in the width direction (between one and the other edges of the fixing belt 42 in the width direction). The central region is a region closer to the center of the fixing belt 42 than the edges of the fixing belt 42 in the width direction when viewed in the direction normal to the fixing belt 42. The shape of the second component 402 is not limited to a rectangular parallelepiped shape, and may instead be another shape. The second contact surface 4021 is not limited to a flat surface, and may instead be a curved surface.

The second contact surface 4021 of the second component 402 pushes the fixing belt 42 in a direction toward the outer peripheral surface of the fixing belt 42, thereby applying tension to the fixing belt 42. Since the second component 402 pushes the fixing belt 42 in the direction toward the outer peripheral surface of the fixing belt 42, as illustrated in FIG. 7, a portion of the fixing belt 42 that is in contact with the second contact surface 4021 (region A11) is farther in the direction toward the outer peripheral surface of the fixing belt 42 than portions of the fixing belt 42 that are not in contact with the second component 402 (regions A12 and A13). Since the central portion of the fixing belt 42 in the width direction is farther in the direction toward the outer peripheral surface of the fixing belt 42 than both ends of the fixing belt 42 in the width direction due to the second component 402, the tension applied to the central portion of the fixing belt 42 in the width direction is greater than the tension applied to both ends of the fixing belt 42 in the width direction.

Figure 8:
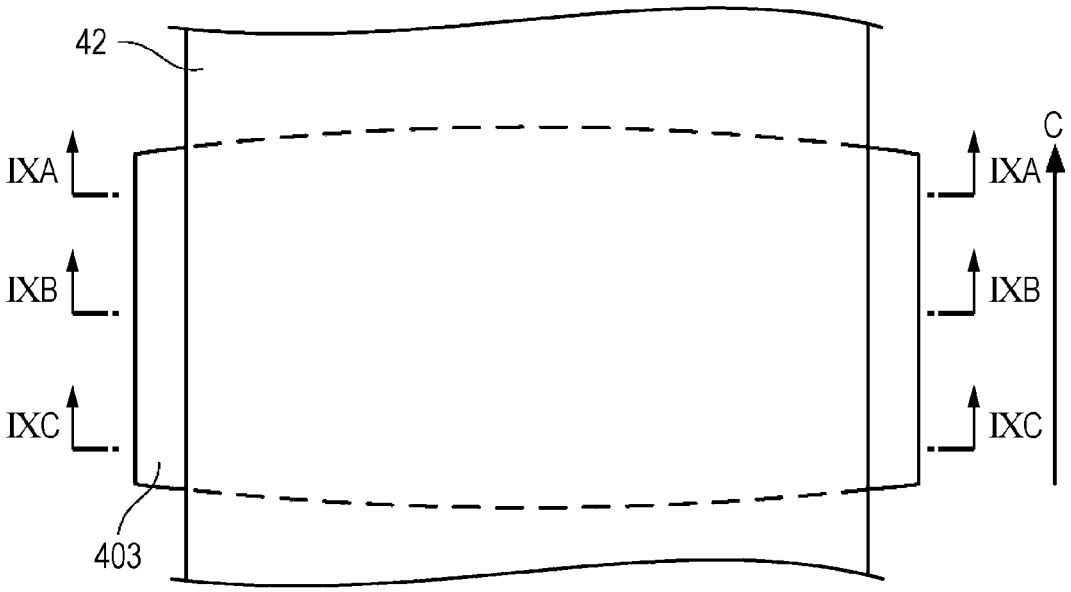
FIG. 8 illustrates a portion of the fixing belt that is in contact with a third component, viewed from the outer periphery of the fixing belt.
Figure 9A:
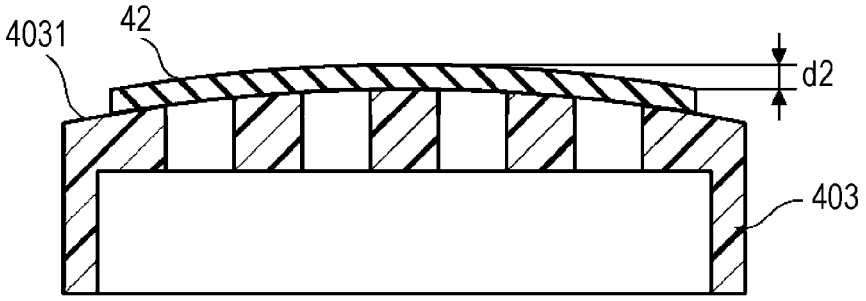
FIGS. 9A, 9B, and 9C are sectional views of FIG. 8 taken along lines IXA-IXA, IXB-IXB, and IXC-IXC, respectively.
Figure 9B:
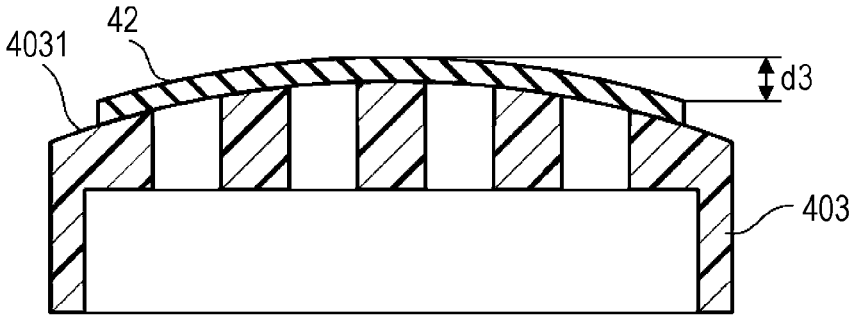
Figure 9C:
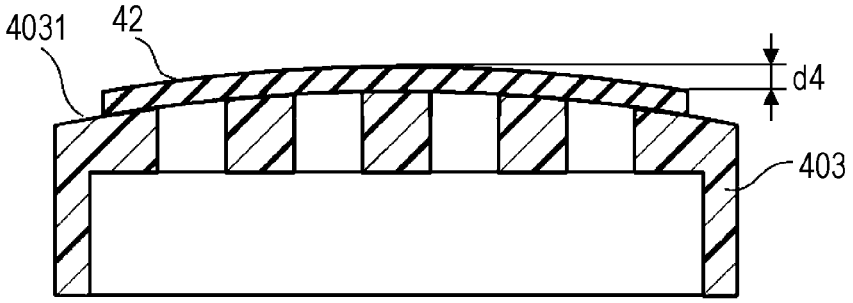

The third component 403 also applies tension to the fixing belt 42, and is made of a resin. The third component 403 is an example of a third unit according to an exemplary embodiment of the present disclosure. The third component 403 is located downstream of the second component 402 in the rotation direction of the fixing belt 42 (direction of arrow c). The third contact surface 4031 does not face the fixing roller 41. FIG. 8 illustrates a portion of the fixing belt 42 that is in contact with the third component 403, viewed from the outer periphery of the fixing belt 42. FIGS. 9A, 9B, and 9C are sectional views of FIG. 8 taken along lines IXA-IXA, IXB-IXB, and IXC-IXC, respectively.

The third contact surface 4031 of the third component 403 is longer than the width of the fixing belt 42 in the width direction of the fixing belt 42, and is in contact with the fixing belt 42 from one end to the other end of the fixing belt 42 in the width direction. The third contact surface 4031 of the third component 403 pushes the fixing belt 42 in the direction toward the outer peripheral surface of the fixing belt 42, thereby applying tension to the fixing belt 42. The third contact surface 4031 is curved. As illustrated in FIGS. 9A to 9C, when viewed in the rotation direction of the fixing belt 42, the central portion of the third contact surface 4031 in the width direction is farther in a direction toward the fixing belt 42 than both ends of the third contact surface 4031 in the width direction. Since the third contact surface 4031 of the third component 403 is shaped such that the central portion thereof in the width direction of the fixing belt 42 is farther in the direction toward the fixing belt 42 than both ends thereof, the tension applied to the central portion of the fixing belt 42 in the width direction is greater than the tension applied to both ends of the fixing belt 42 in the width direction.

The third contact surface 4031 is shaped such that at the position of the sectional view taken along line IXA-IXA (FIG. 9A), the distance in the direction normal to the fixing belt 42 between a central portion of the outer peripheral surface of the fixing belt 42, which is positioned outermost, and an end of the outer peripheral surface of the fixing belt 42 in the width direction of the fixing belt 42 is d2. In addition, the third contact surface 4031 is shaped such that at the position of the sectional view taken along line IXB-IXB (FIG. 9B), the distance in the direction normal to the fixing belt 42 between a central portion of the outer peripheral surface of the fixing belt 42, which is positioned outermost, and an end of the outer peripheral surface of the fixing belt 42 in the width direction of the fixing belt 42 is d3 and such that at the position of the sectional view taken along line IXC-IXC (FIG. 9C), the distance in the direction normal to the fixing belt 42 between a central portion of the outer peripheral surface of the fixing belt 42, which is positioned outermost, and an end of the outer peripheral surface of the fixing belt 42 in the width direction of the fixing belt 42 is d4. Since the distance d3 is greater than the distances d2 and d4, the tension applied to the fixing belt 42 at the position of the sectional view taken along line IXB-IXB is greater than the tensions applied to the fixing belt 42 at the positions of the sectional views taken along lines IXA-IXA and IXC-IXC.

The third component 403 forms a pre-nip region, in which the fixing belt 42 and the fixing roller 41 are in contact with each other, at a location closer to the third component 403 than the nip region formed by the fixing roller 41 and the first component 401 (location upstream of the nip region in the rotation direction of the fixing belt 42). The fixing belt 42 has no component in contact with the inner peripheral surface thereof and is movable in a direction toward the inner peripheral surface thereof in the pre-nip region.

A portion of the fixing belt 42 that is in contact with the second component 402 and a portion of the fixing belt 42 that is in contact with the third component 403 are arranged so that a distance d1 (FIG. 7) is greater than the distance d3 (FIG. 9B). The distance d1 is a distance in the direction normal to the fixing belt 42 between a central portion of the fixing belt 42, which is positioned outermost, and an end of the fixing belt 42 in the width direction at the position of the second component 402. The distance d3 is the distance in the direction normal to the fixing belt 42 between a central portion of the fixing belt 42, which is positioned outermost, and an end of the fixing belt 42 in the width direction at the position of the third component 403. Since the central portion of the fixing belt 42 in the width direction is positioned further outward at the second component 402 than at the third component 403, the tension applied to the fixing belt 42 by the second component 402 is greater than the tension applied to the fixing belt 42 by the third component 403.

The tension applied to the fixing belt 42 by each of the second component 402 and the third component 403 is greater at the central portion than at both ends in the width direction. Therefore, the fixing belt 42 receives a force in a direction from the central portion toward one end in the width direction and a force in a direction from the central portion toward the other end in the width direction. The force in the direction from the central portion toward one end in the width direction and the force in the direction from the central portion toward the other end in the width direction cancel each other, so that movement of the fixing belt 42 in the width direction of the fixing belt 42 is reduced.

Modifications

Although an exemplary embodiment of the present disclosure has been described, the present disclosure is not limited to the above-described exemplary embodiment, and various other exemplary embodiments are possible. For example, the present disclosure may be carried out by modifying the above-described exemplary embodiment as described below. The above-described exemplary embodiment and modifications described below may also be combined.

In the above-described exemplary embodiment, the fixing roller 41 has a heat source provided therein. However, the fixing roller 41 may instead be configured such that no heat source is provided therein. When the fixing roller 41 has no heat source, a heat source that heats the fixing belt 42 may be provided on the inner peripheral surface of the fixing belt 42.

Although the third contact surface 4031 is curved in the above-described exemplary embodiment, the third contact surface 4031 is not limited to a curved surface, and may instead be flat. When the third contact surface 4031 is flat, the third contact surface 4031 may be formed of a flat surface that is shorter than the width of the fixing belt 42 in the width direction of the fixing belt 42. Alternatively, the third contact surface 4031 may be formed by combining flat surfaces so that the central portion thereof in the width direction of the fixing belt 42 is farther in the direction toward the fixing belt 42 than both ends thereof. Alternatively, similar to the second component 402, the third component 403 may have a rectangular parallelepiped shape that is shorter than the width of the fixing belt 42.

In the above-described exemplary embodiment, the distance d3 is greater than the distances d2 and d4. However, these distances are not limited to those in the exemplary embodiment. For example, the distance d4 may be greater than the distances d3 and d2. Alternatively, the distances d2, d3, and d4 may be equal to each other.

In the above-described exemplary embodiment, the third component 403 that applies tension to the fixing belt 42 is located upstream of the nip region formed by the fixing roller 41 and the first component 401 and downstream of the second component 402 in the rotation direction of the fixing belt 42. However, the position of a component that applies tension to the fixing belt 42 is not limited to that in the exemplary embodiment. For example, a component that applies tension to the fixing belt 42 may be disposed downstream of the first component 401 and upstream of the second component 402 in the rotation direction of the fixing belt 42. The component disposed at this position may have a structure similar to that of the first component 401, or a structure similar to that of the third component 403.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

an endless belt;

a pressing unit that is in contact with an outer peripheral surface of the belt and that rotates the belt;

a first unit that is provided on an inner peripheral surface of the belt and that retains the belt in contact with the pressing unit;

a second unit provided on the inner peripheral surface of the belt and located downstream of the first unit in a rotation direction of the belt, the second unit applying tension to the belt and including a portion that is in contact with a central portion of the belt in a width direction of the belt and that is farther in a direction toward the outer peripheral surface of the belt than both ends of the belt in the width direction of the belt; and a third unit provided on the inner peripheral surface of the belt and located downstream of the second unit in the rotation direction of the belt, the third unit applying tension to the belt and including a portion that is in contact with the central portion of the belt in the width direction of the belt and that is farther in the direction toward the outer peripheral surface of the belt than both ends of the belt in the width direction of the belt, wherein a distance in a direction normal to the belt between a portion of the belt positioned farthest in the direction toward the outer peripheral surface at a position of the second unit and an end of the belt in the width direction of the belt at the position of the second unit is greater than a distance in the direction normal to the belt between a portion of the belt positioned farthest in the direction toward the outer peripheral surface at a position of the third unit and an end of the belt in the width direction of the belt at the position of the third unit.

2. The fixing device according to claim 1, wherein the third unit forms a region in which the outer peripheral surface of the belt is in contact with the pressing unit and in which the belt is movable in a direction toward the inner peripheral surface, the region being located upstream of the first unit in the rotation direction of the belt, and wherein the third unit is in contact with the inner peripheral surface of the belt over a width of a region in which the outer peripheral surface of the belt comes into contact with a recording medium.

3. The fixing device according to claim 2, wherein the third unit includes a surface that is in contact with the inner peripheral surface of the belt, wherein a central portion of the surface of the third unit in the width direction of the belt is farther in the direction toward the outer peripheral surface of the belt than both ends of the surface of the third unit in the width direction of the belt, and wherein a central portion between upstream and downstream ends of the surface of the third unit in the rotation direction of the belt is farther in the direction toward the outer peripheral surface of the belt than the upstream and downstream ends.

4. The fixing device according to claim 1, wherein the pressing unit is a roller, wherein the second unit is disposed on an extension line of a line connecting a center of the roller and the first unit, and wherein the third unit is positioned so as not to face the roller across the belt.

5. The fixing device according to claim 1, wherein a length of a portion of the second unit that is in contact with the belt in the width direction of the belt is less than a length of the belt in the width direction of the belt.

6. The fixing device according to claim 5, wherein a portion of the second unit that is in contact with the belt includes a flat surface.

7. A fixing device comprising:

an endless belt;

a pressing unit that is in contact with an outer peripheral surface of the belt and that rotates the belt;

a first unit that is provided on an inner peripheral surface of the belt and that retains the belt in contact with the pressing unit;

a second unit provided on the inner peripheral surface of the belt and located downstream of the first unit in a rotation direction of the belt, the second unit applying tension to the belt so that the tension applied to a central portion between both ends of the belt in a width direction of the belt is greater than the tension applied to both ends of the belt in the width direction of the belt; and a third unit provided on the inner peripheral surface of the belt and located downstream of the second unit in the rotation direction of the belt, the third unit applying tension to the belt so that the tension applied to the central portion between both ends of the belt in the width direction of the belt is greater than the tension applied to both ends of the belt in the width direction of the belt, wherein a distance in a direction normal to the belt between a portion of the belt positioned farthest in the direction toward the outer peripheral surface at a position of the second unit and an end of the belt in the width direction of the belt at the position of the second unit is greater than a distance in the direction normal to the belt between a portion of the belt positioned farthest in the direction toward the outer peripheral surface at a position of the third unit and an end of the belt in the width direction of the belt at the position of the third unit.

8. An image forming apparatus comprising:

an image forming unit that forms an image on a recording medium; and the fixing device according to claim 1 to which the recording medium having the image formed thereon by the image forming unit is transported and which fixes the image to the recording medium.

* * * * *